United States Patent [19]

DeCaro

[11] 4,070,889

[45] Jan. 31, 1978

[54] LINEAR PULL SETTING TOOL

[75] Inventor: Charles J. DeCaro, Marshfield, Mass.

[73] Assignee: Textron Inc., Providence, R.I.

[21] Appl. No.: 732,313

[22] Filed: Oct. 14, 1976

[51] Int. Cl.[2] ..... B21J 15/12

[52] U.S. Cl. ..... 72/114

[58] Field of Search ..... 72/114, 391

[56] References Cited

U.S. PATENT DOCUMENTS 2,437,191 3/1948 Gill ..... 72/114

FOREIGN PATENT DOCUMENTS 2,150,044 4/1972 Germany ..... 172/114

*Primary Examiner*—James L. Jones, Jr.

*Attorney, Agent, or Firm*—Webb, Burden, Robinson & Webb

[57] ABSTRACT

A setting tool includes an adapter for alternately providing rotary and linear motion of the adapter shaft, which engages the fastener. The adapter includes a housing for attachment to a setting tool such as an air gun. A drive member within the housing is secured to the main drive shaft of the air gun for rotation therewith. The drive member includes a perimetrical helical power screw. The adapter shaft extends through the housing and has a rearward end including means such as splines and a spring loaded detent assembly for rotative cooperation with the drive member. The forward end of the adapter shaft engages the fastener. Biasing means are positioned between the adapter shaft and the drive shaft. An inner sleeve positioned about the adapter shaft is threaded for engagement and movement along the drive member. A pick-up means is secured to the adapter shaft. In a first position the rotation of the drive shaft is translated through the drive member to cause rotation of the adapter shaft and in a second position the biasing means is retracted to remove the rotative cooperation and the sleeve advances along the drive member engaging the pick-up means to cause linear movement of the adapter shaft.

14 Claims, 2 Drawing Figures

LINEAR PULL SETTING TOOL

FIELD OF THE INVENTION

My invention relates to a linear pull setting tool and, more particularly, to an adapter for setting fasteners wherein the fastener setting occurs initially through a torquing movement and thereafter through a linear pull of the fastener engaging adapter shaft.

DESCRIPTION OF THE PRIOR ART

Collapsible threaded anchoring fasteners are utilized in blind holes or where the confines of a fabricated structure are such that it is impossible to gain access to the rear side of the structure. These fasteners which are sometimes referred to as blind, self-locking anchor nuts are placed in a hole in the workpiece which is generally thin gauge sheet or plate stock. The fasteners are generally internally threaded at their tail end and include a thin wall section at their head end. With the use of a special tool which threads into the fastener, the inserts are collapsed in a way to cause the thin wall of the fastener to form the upset head of the connection. Thereafter, the setting tool is removed and the fastener can accommodate a threaded bolt or the like.

Heretofore the setting tool generally operates in one of two ways. Some setting tools operate strictly on a torquing motion which draws the fastener tightly against the tool and thereafter collapses the fastener as the torquing action of the tool continues beyond the upset load of the fastener. Such a tool requires a highly sophisticated fastener in terms of concentricity and symmetry since the fastener is expected to collapse uniformly in response to a twisting motion. A slight variation in wall thickness resulting from an off-center hole can cause improper setting. The difficulty with this arrangement resides more in the difficulty of obtaining such a fastener than in the torquing action of the setting tool. In other words, fasteners may be rejected in substantial lot qualities if certain of the fasteners improperly collapse upon setting. The user simply has no way to test each fastener other than try a few from a given lot.

Such a tool has a further drawback in that the barrel end of the setting tool must frictionally engage and bite into the fastener head so as to keep the fastener from rotating as the torquing motion is applied to the blind end of the fastener.

It is possible to provide a setting tool which initially screws into the fastener and thereafter pulls the fastener rather than twists it to cause collapsing. However, such setting tools require detailed porting and valving to provide for the two independent types of motion to the single shaft which engages the fastener. These tools then become both costly and difficult to use because of their cumbersome size.

SUMMARY OF THE INVENTION

My invention incorporates the advantages of the abovereferred to setting tools into a single device without the inherent drawbacks of either tool. Specifically, an initial torquing action is achieved to thread the tool onto the fastener and thereafter a linear pull is utilized to collapse and set the fastener. This, therefore, eliminates the need for the high degree of concentricity and symmetry of the fastener. I further achieve these two motions for the setting tool without the need for exhaustive porting and valving thereby providing a simple operating and light to use device.

My invention further takes advantage of the initial relatively low torquing requirements in conjunction with a relatively high linear pull requirement to cause the formation of the upset head.

My invention is a fastener setting tool having an adapter which includes an adapter shaft capable of rotation in a first position and linear movement in a second position. The adapter shaft extends through a housing which is connectable to a tool such as an air gun. A drive member is positioned within the housing and is secured to the drive shaft of the air tool so as to rotate therewith. The drive member includes external power screw threads. Positioned in mating engagement with the screw threads and for movement therealong is an inner sleeve. The inner sleeve is restricted to linear movement. Associated with the rear end of the adapter shaft is a detent assembly which rotates with the drive member and translates the rotation of the drive member to the adapter shaft. The adapter shaft can be moved out of engagement with the detent assembly so that it does not rotate. Somewhat simultaneously with the removal of the detent assembly, the inner sleeve engages the adapter shaft to cause linear movement thereof as the inner sleeve advances along the drive member. The relative movements are generally reversible to permit removal of the fastener from the tool and position the tool in its starting position.

DESCRIPTION OF THE PREFERRED EMBODIMENTS

Figure 1:
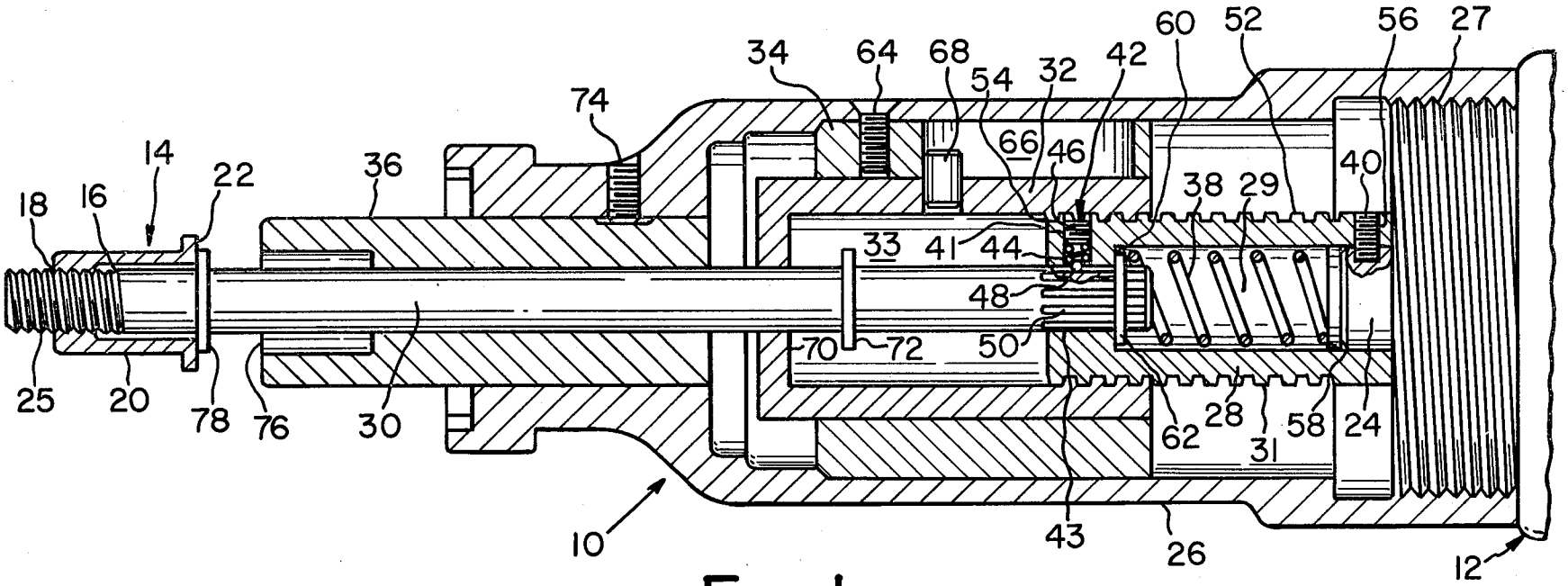
FIG. 1 is a section through the center line of my adapter and a fastener in engagement therewith.

My adapter, generally designated 10, includes an outer housing 26 having internal threads 27 at one end for engagement with an air gun 12 which is only partially shown, FIG. 1. Air gun 12 is the standard type having a trigger or other release mechanism for driving a drive shaft 24 in both a clockwise and counterclockwise rotation. The adapter 10 is utilized to set a fastener 14 of the collapsible threaded insert type. Fastener 14 normally has a fastener head 22, a collapsible thin wall 20 adjacent the head 22 and an internal bore 16 which is threaded with internal threads 18 at the end opposite the head 22. The fastener 14 can be either open ended or closed. Setting is accomplished by collapsing the thin wall 20 to form the upset head without disrupting the internal threads which then can accommodate a bolt or the like.

Positioned within the housing 26 is an annular drive member 28 having a bore 56 at one end through the annular wall 31. Drive member 28 is positioned with respect to drive shaft 24 so that set screw 40, positioned within the drive member bore 56, engages drive shaft 24 so as to cause drive member 28 to rotate along with the drive shaft 24.

Drive member 28 includes a central chamber 29 defined by the wall 31 and an annular shoulder 60 positioned at one end. The wall 31 includes on its outer perimetric surface a helical thread 52. Helical thread 52 is of the square type as in a power screw or jack thread. A second bore 41 extends through wall 31 and annular shoulder 60 of drive member 28. Bore 41 extends into the passageway 43 which extends through the annular shoulder 60 and communicates with the central chamber 29 of drive member 28.

Extending axially through the housing 26 is the adapter shaft 30. At its forward end, adapter shaft 30 includes external threads 25 for engaging the internal threads 18 of the fastener 14. The opposite end of adapter shaft 30 includes a plurality of splines 50 extending coaxially along the outer surface of shaft 30 a short distance. Shaft 30 extends through a barrel 36 connected to the forward end of housing 26 by means of a set screw 74. It will be apparent that barrel 36 could be integrally formed with the outer housing 26. Adapter shaft 30 also extends through the drive member passageway 43 and terminates within central chamber 29 of the drive member 28. The splines 50 are dimensioned so that they extend through the passageway 43 in the assembled condition. Adapter shaft 30 is retained in place by means of a snap ring 62 which connects to the end of shaft 30 and abuts against the shoulder 60 of the drive member 28.

A detent assembly 42 is positioned within the bore 41 of the drive member 28 so as to be in engagement with the splines 50 of the adapter shaft 30. Specifically, detent assembly 42 comprises threaded plug 46, coil spring 44 and detent ball 48. The plug 46 which threadably engages the bore 41 abuts the small coil spring 44 which in turn is in engagement with ball 48 positioned in the bottom of the bore 41. Rotation of the drive shaft 24 carries with it the drive member 28 and detent assembly 42. The ball 48 engages the splines 50 to cause the adapter shaft 30 to also rotate. As will be described hereinafter, the torquing motion is utilized to cause engagement of the fastener.

Positioned within the chamber 29 of the drive member 28 is a coil spring 38 which engages at one end the snap ring 62 and at the other end with thrust bearing 58 which is also adjacent drive shaft 24. The thrust bearing 58 prevents tangling of the coil spring 28 as the shaft 24 rotates.

Externally mounted for movement along the square threads 52 of drive member 28 is pull sleeve 32. Pull sleeve 32 is annular and is positioned within the housing 26. Sleeve 32 is concentric to the adapter shaft 30 which passes through the central opening 33 defined by pull sleeve 32. The forward end of pull sleeve 32 includes annular shoulder 70 whereas the rearward end includes internal square threads 54 which matingly engage the external threads 52 of the drive member 28 so as to permit the pull sleeve to move along the drive member 28.

Concentrically positioned in adjacent relationship to the pull sleeve 32 is outer sleeve 34. Outer sleeve 34 is rigidly mounted to housing 26 by means of set screw 64 connected therebetween. Outer sleeve 34 includes an elongated slot 66 which accommodates a pin 68 connected to the pull sleeve 32. Because the slot 66 has a width dimension substantially equal to the cross sectional dimension of the pin 68, pull sleeve 32 is prevented from any rotation and can only move more linearly a distance equal to the length of the slot 66. While outer sleeve 34 is a convenient way to control the movement of sleeve 32, an equivalent slot could be utilized in the housing 26.

Mounted to adapter shaft 30 and positioned within chamber 33 of pull sleeve 32 is a pick-up ring 72. As will be described in more detail hereinafter as the pull sleeve 32 moves rearward on the drive member 28, the shoulder 70 of pull sleeve 32 engages the pick-up ring 72 thereby causing a linear movement of adapter shaft 30.

The forward end of barrel 36 includes a counterbore 76. The counterbore 76 accommodates a locater pin 78 mounted on the forward end of the adapter shaft 30 against which the fastener head 22 rests in its fully screwed on position. In other words, the locater pin 78 moves into the counterbore 76 as the adapter shaft 30 moves linearly so the end of barrel 36 can engage the fastener head 22 and permit the wall 20 of fastener 14 to collapse rather than have the fastener 14 merely pull out of the hole.

Figure 2:
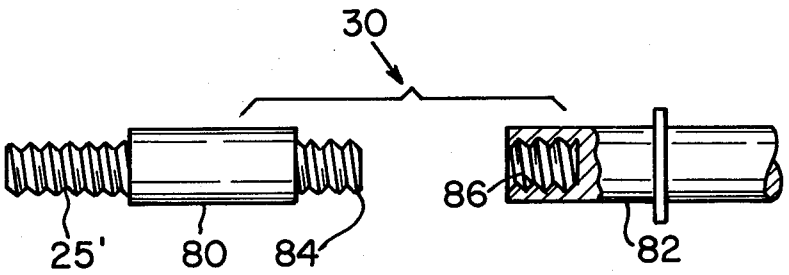
FIG. 2 is an exploded view of a modified adapter shaft.

In order to accommodate fasteners having different internal diameters, the adapter shaft can be provided in two sections. Specifically, adapter shaft 30' includes a fastener engageable section 80 having a threaded forward end 25' for engaging the fastener and a rearward threaded end 84 for engaging an internal tap 86 on the remainder of the adapter shaft 82, FIG. 2. In this manner, a single adapter shaft section 82 can accommodate a number of fastener engaging ends 80 to accommodate the different size fasteners that are utilized.

My adapter works as follows. The worker positions the fastener 14 on the threaded end of adapter shaft 30 and thereafter engages the trigger (not shown) of the air gun 12. The trigger activates the drive shaft 24 thereby causing clockwise rotation of the drive member 28. Rotation of the drive member 28 has a dual effect. In the first instance it causes the detent assembly 42 to engage the splines to cause rotation of the adapter shaft 30 as previously described. It further causes pull sleeve 32 to advance rearwardly along the square threads 52. As the adapter shaft 30 turns, the threaded end of adapter shaft 30 screws into fastener 14 until fastener head 22 engages the pin locater 78.

Thereafter, the workman inserts the fastener 14 into the hole in the workpiece and pushes the tool 12 forward. This causes adapter shaft 30 to move rearward moving the splines 50 out of engagement with the detent assembly 42. Thereafter, the ball only engages the smooth portion of the adapter shaft 30 causing no rotative movement. Continued or reinitiated activation of the drive shaft 24 results in shoulder 70 of pull sleeve 32 engaging pick-up ring 72 to cause the adapter shaft 30 to move linearly rearward along with the pull sleeve 32. Since the forward end of the barrel 36 is now against the fastener head 22, the fastener wall 20 is caused to collapse and form the upset head.

The stroke of the tool is controlled by the distance of the slot 66 since once pin 68 reaches the end of slot 66 the air tool stalls out in standard fashion. Thereafter, the air gun is reversed so that activation thereof causes shaft 24 to rotate in a counterclockwise direction. The reversal of the air gun is also standard and the structural details do not form a part of this invention. At the same time it is necessary to release the forward thrust on the air gun 12 so that the spring 38 urges the adapter shaft 30 forward and places the splines 50 once again into engagement with the detent assembly 42. The continuation of the counterclockwise rotation of drive shaft 24 causes adapter shaft 30 to once again rotate thereby disengaging the threaded shaft end 25 from the fastener. At the same time, the pull sleeve 32 has advanced along drive member 28 until pin 68 reaches its forwardmost position in slot 66 and the tool again stalls out leaving the adapter 10 in position for the next setting operation.

It will be recognized that means other than the detent assembly and splines can be used to translate the rotary motion of the drive shaft to the adapter shaft. For example, the perimeter of the adapter shaft rear end could include teeth for engagement with a clutch plate forming a part of the drive member. Likewise, the adapter shaft could terminate in a frictional element which would engage the drive shaft upon compression of a spring therebetween as in a friction clutch. The detent assembly as described is set forth since it is a preferred means of providing the very light initial forces necessary to thread the adapter shaft onto the fastener.

I claim:

1. An adapter suitable for attachment to a driving tool having a rotating drive shaft comprising:

A. a housing adapted for attachment to the tool;

B. a drive member positioned within the housing and adapted for securement to the drive shaft for rotation therewith;

C. an adapter shaft coaxially extending through the adapter and having a rearward end and a forward end, said rearward end including means for rotative cooperation with the drive member and said forward end adapted for association with a fastener;

D. a movable inner sleeve positioned about the adapter shaft;

E. means associated with the drive member for engaging an end of the inner sleeve for advancing the inner sleeve along the drive member;

F. means associated with the inner sleeve for preventing rotation of the sleeve relative to the drive member;

G. pick-up means secured to the adapter shaft and positioned for engagement by the inner sleeve;

whereby in a first position the rotation of the drive shaft is translated through the drive member and the rotative means to cause rotation of the adapter shaft and in a second position the rotative means is removed from cooperation with the adapter shaft and the sleeve advances along the drive member and engages the pick-up means to cause linear movement of the adapter shaft.

2. The adapter of claim 1, said drive member being annular, said engaging means comprising external threads extending along a forward portion of said drive member for advancing the inner sleeve therealong.

3. The adapter of claim 1, said means for rotative cooperation comprising a plurality of perimetric splines extending along the rearward end of the adapter shaft and said drive member having a detent assembly positioned therewithin for engagement with said splines to cause rotation of said adapter shaft in the first position.

4. The adapter of claim 1, said forward end of the adapter shaft being externally threaded for threadable engagement with the interior of a fastener.

5. The adapter of claim 4, said adapter shaft comprising a first portion including the rearward end and a second portion adapted for threadable engagement to the first portion and including the forward end.

6. The adapter of claim 1 including biasing means positioned adjacent the adapter shaft rearward end for urging the adapter shaft away from the drive member, said biasing means being retracted in the second position.

7. The adapter of claim 6, said biasing means comprising a coil spring adjacent a snap ring secured along the rearward end of the adapter shaft and at an opposite end adjacent a thrust bearing positioned in operable engagement with the drive shaft.

8. The adapter of claim 2, said inner sleeve being annular and having an internally threaded rear end in mating threadable engagement with said external threads.

9. The adapter of claim 8, said inner sleeve having a forward end defined by a shoulder for engagement with the pick-up means.

10. The adapter of claim 1, said inner sleeve rotation prevention means comprising a pin extending outwardly from the sleeve for linear movement along a slotted member positioned about said inner sleeve.

11. The adapter of claim 10, said slotted member comprising an outer annular sleeve concentrically positioned within and connected to said housing, said sleeve having an elongated slot to accommodate said pin.

12. The adapter of claim 1, said pick-up means comprising a pin extending through and retainably held by said adapter shaft.

13. The adapter of claim 1, said housing terminating in a forward end having a counterbore to accommodate a fastener locator ring mounted on the adapter shaft.

14. In a pneumatic installation tool for setting internally threaded collapsible fasteners including an air motor and a drive shaft, the improvement comprising an adapter having:

A. an outer housing suitable for attachment to said air motor;

B. a drive member positioned within the housing and secured to said drive shaft for rotation therewith, said drive member having external threads along at least a forward portion thereof;

C. an adapter shaft coaxially extending through the adapter, said adapter shaft terminating at one end in a plurality of axially extending perimetrical splines and at the other end in threads suitable for engaging the fastener;

D. a spring loaded ball detent communicating between the drive member and the adapter shaft splines;

E. an inner sleeve positioned about the adapter shaft and having a rear end terminating in an internally threaded bore for movable engagement along the drive member external threads and a forward end defining a shoulder;

F. a pin extending outward from the inner sleeve;

G. an outer sleeve positioned concentrically about the inner sleeve and connected to the housing, said outer sleeve including an elongated slot accommodating said pin to restrict said inner sleeve to linear motion;

H. a pick-up member secured to the adapter shaft and positioned so as to engage the inner sleeve shoulder;

I. spring means positioned between the adapter shaft and the drive shaft;

whereby in a first position the rotation of the drive shaft is translated to the adapter shaft through the detent to cause rotation of the adapter shaft and in a second position the spring means are contracted so as to remove the splines from engagement with the detent and the inner sleeve advances along the drive member to engage the pick-up member and cause linear movement of the adapter shaft.

* * * * *